US005527145A

United States Patent [19]

Duncan

[11] Patent Number: 5,527,145

[45] Date of Patent: Jun. 18, 1996

[54] MORTARING MADE EASIER

[76] Inventor: Joseph C. Duncan, 28 Creek Meadow La., Rochester, N.Y. 14626

[21] Appl. No.: 892,567

[22] Filed: Jun. 3, 1992

[51] Int. Cl.[6] ..... E04G 21/22

[52] U.S. Cl. ..... 414/786; 52/747.13; 52/749.14

[58] Field of Search ..... 414/10, 736; 52/747, 52/749, 747.13, 749.14

[56] References Cited

U.S. PATENT DOCUMENTS

| | | | |
|---|---|---|---|
| 2,585,283 | 2/1952 | Sommers | 52/749 X |
| 3,782,047 | 1/1974 | Stolz | 52/747 X |
| 5,016,419 | 5/1991 | Boot et al. | 414/10 X |
| 5,184,934 | 2/1993 | Gallo | 414/10 X |
| 5,284,000 | 2/1994 | Milne et al. | 52/749 |

FOREIGN PATENT DOCUMENTS

| | | | |
|---|---|---|---|
| 112552 | 4/1990 | Japan | 52/749 |
| 673498 | 3/1990 | Switzerland | 52/749 |
| 2221490 | 2/1990 | United Kingdom | 52/749 |

*Primary Examiner*—Michael S. Huppert
*Assistant Examiner*—Janice L. Krizek

[57] ABSTRACT

The entire unit containing components bolted together is designed to hold bricks, blocks, and a horizontal mobile mortar tray, all easily accessible and within reach so that a mason can place the unit where it is needed. This unit can be used in three ways; to lift one block at a time, to lift three blocks at a time, and to use just the mobile mortar tray. To lift one block or three blocks, a hydraulic system is used. Also, to make mortaring easier, a mortaring guide placed on a block will enable mortar to be placed the length of the block with a minimal amount of spillage. A level line with printed joint spacing, when stretched to the correct length, can readily and simply make the joints faster and eliminate chance of variation error.

1 Claim, 3 Drawing Sheets

MORTARING MADE EASIER

FIELD OF INVENTION

This invention relates to a masonry procedure, specifically the use of an apparatus for lifting blocks for mortaring a wall.

BACKGROUND OF THE INVENTION

The current method used to mortar blocks is to have a laborer place mortar on a mortarboard and place a stack of blocks on both sides of a mortarboard. A mason then places mortar where a wall is to be built. Said mason picks up a block behind him and mortars one end of said block which will become a joint end, then lays the block where the mortar has been placed. Member 31 shows an example of a mortar joint, sometimes a mason will increase the joint after four or five blocks have been laid and then has to realign said blocks, tapping to move said blocks to connect the error. The invention eliminates spacing variances. Currently a laborer places blocks on both sides of a stationary mortarboard. This does not allow the mason to have material always within reach and requires extra steps to retrieve material, on a long wall that is to be built. A number of mortarboards are placed and also more blocks are added between said mortarboards. This invention has one mobile mortar tray and material is always within reach. A mason presently picks up heavy blocks by hand and carries them to be placed on a wall that is being built. A procedure that has been in existence for decades, this is very strenuous work and results in many back sprains, lost time, and doctor bills. This invention eliminates manual lifting because it has the hydraulic powered lifting and lowering capability, and the apparatus is on rails and rollers making the apparatus mobile. My invention makes mortaring easier.

SUMMARY OF THE INVENTION

The invention consists of an apparatus that will lift blocks for a mason, shown in FIG. 1. The apparatus has rails and rollers, member 18 and 24, that gives it mobility to move horizontally, and also a hand brake to keep it stationary. The frame, member 19, has a mortar tray member 10 that seats into the frame which is easily removed for cleaning, a hydraulic motor and pump is also bolted at the base of the said frame. A pick-up arm with grippers, member 2, for holding blocks is connected to the lower arm assembly, member 5, and is hinged to the upper arm assembly member 6, that pivots when connected to the stem, member 48. The said stem will rotate above the mortar tray, member 10, not shown is a ball bearing assembly that will allow this rotation. The apparatus has the means to be positioned to pick-up blocks, and place said blocks on a mortared wall, then releases the gripping force and raise the lifting arm, swinging it slightly to the right or left so the mason can finish tapping the first block in place, FIG. 5 shows this. The three grippers assembly have a 1½-inch linear movement shown in member 49, this will allow lowering one block and mortaring the end for a joint, while the other blocks remain suspended. The apparatus has-the capability of extending the lower arm assembly, member 43, the upper arm assembly, member 43, and the stem, member 48, with hydraulic cylinders not shown that will allow this movement. A mortaring guide, member 33, will also make mortaring easier and save on material. By placing the guide against the block it enables the mason to mortar a narrow 1½-inch ledge faster shown in member 37. Waste is also kept at a minimum by placing mortar against the guide to mortar both ledges of a block. The block also has two places to hold on to a handle, member 35, is used when mortaring low. Said handle is also 15 degrees off center to make mortaring easier, when mortaring high a block member 34 is where to hold for easier handling. A line for leveling blocks has 8-inch joint separation marks. For blocks member 28 shows a 16-inch joint separation, and ⅜-inch example at member 31. When a level line is placed tight, it will have the correct spacing and keep joint spacing uniform. Blocks will never need adjusting. Without this line a mason sometimes increases or decreases the joints ever so slightly at each joint and will not notice it until four or five blocks later. Then an adjustment has to be made. With this line a person can readily and simply make the joints and eliminate variation error.

BRIEF DESCRIPTION OF THE DRAWING

The invention will be better understood with reference to drawing in which.

DETAILED DESCRIPTION OF THE PREFERRED EMBODIMENT

Figure 1:
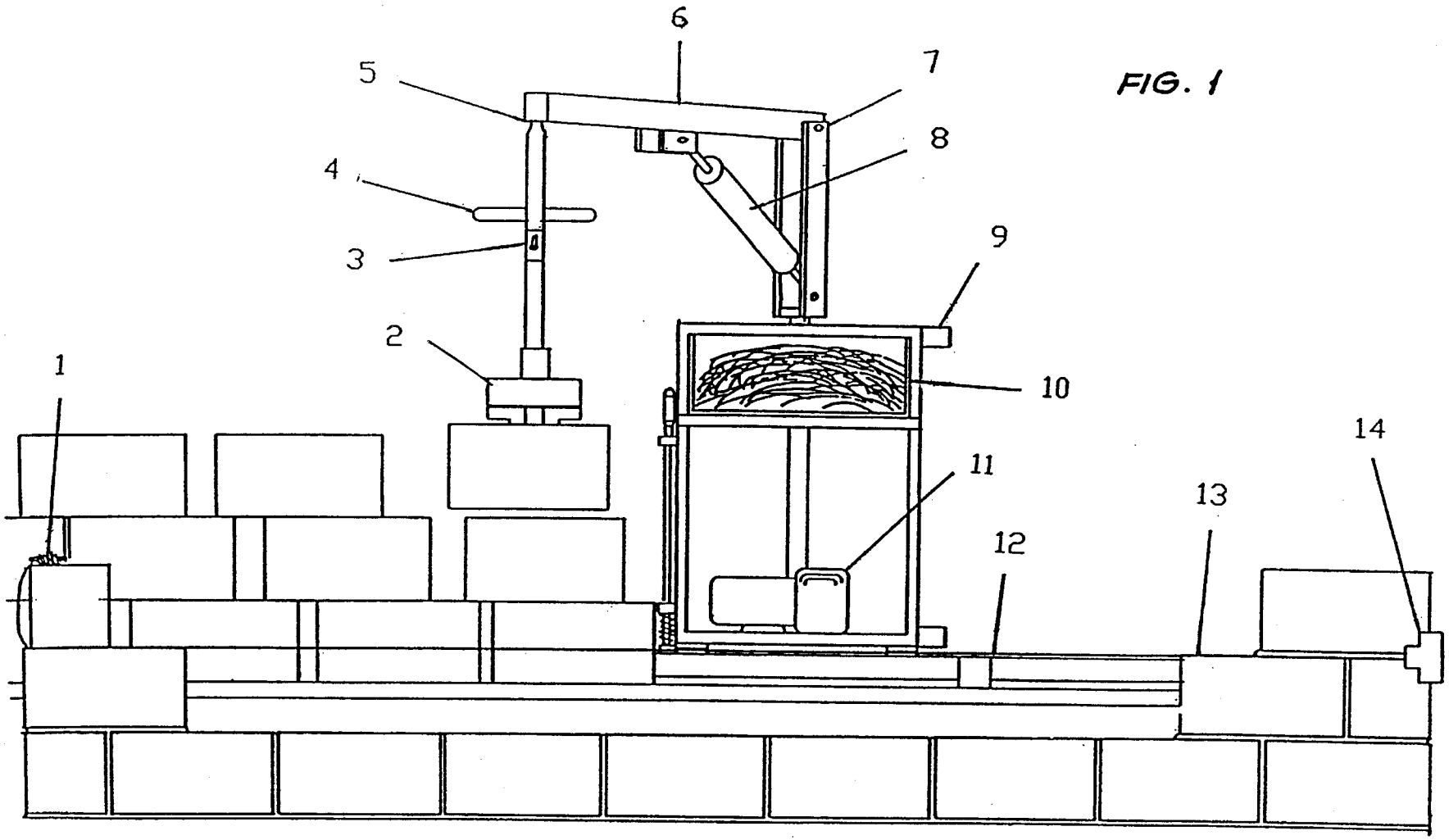
FIG. 1 is a perspective view of an apparatus with the means to place a block on a wall, and after the first layer of blocks are laid, and where the second layer of blocks are laid with a level line showing the height
Figure 4:
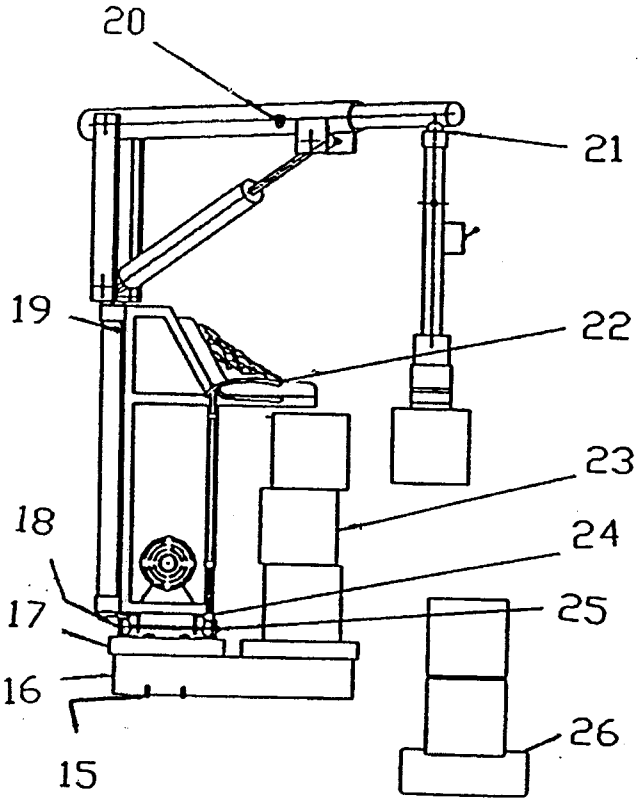
FIG. 4 is a end view of the roller and rails system, a mortar-tray that sets in a frame, and shows how cement blocks are stacked three high horizontally under the mortar-tray.
Figure 2B:
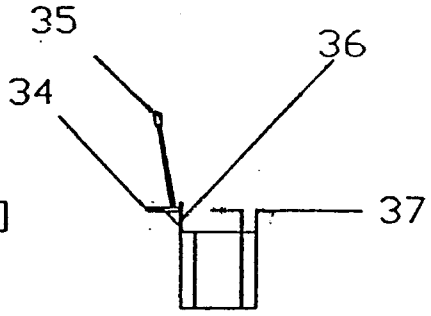
FIG. 2B is a end elevation of 7 guide showing handle for gripping when mortaring low, and member 34 a block that will be held when mortaring high.
Figure 2A:
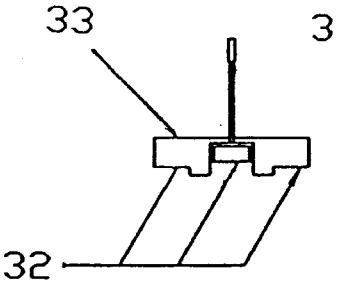
FIG. 2A is a front view of a guide having clearance at the bottom of said guide with straddle not shown. Flanges in cement blocks.
Figure 3:
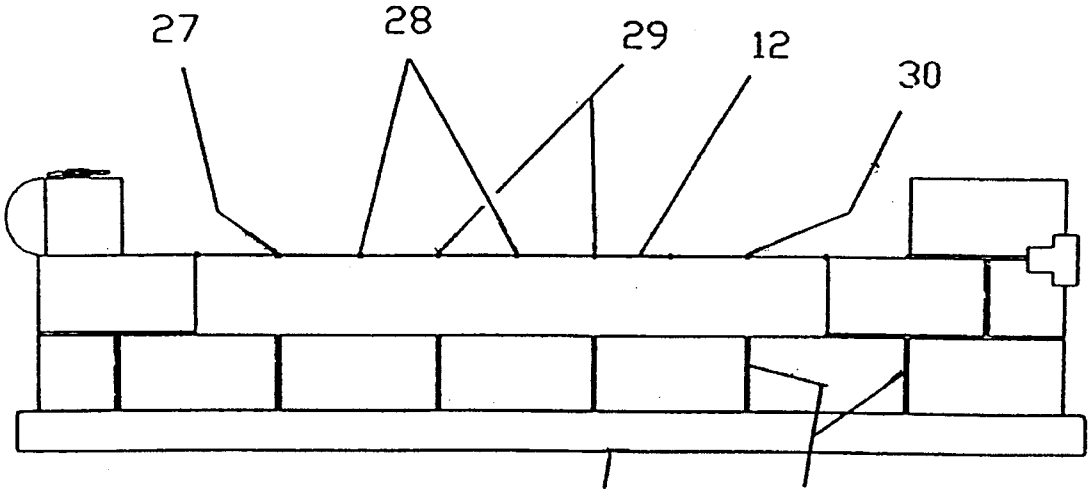
FIG. 3 is a perspective view of a level line having the means to keep mortar joints uniform by having ⅜-inch, joint marking on the said line.
Figure 5:
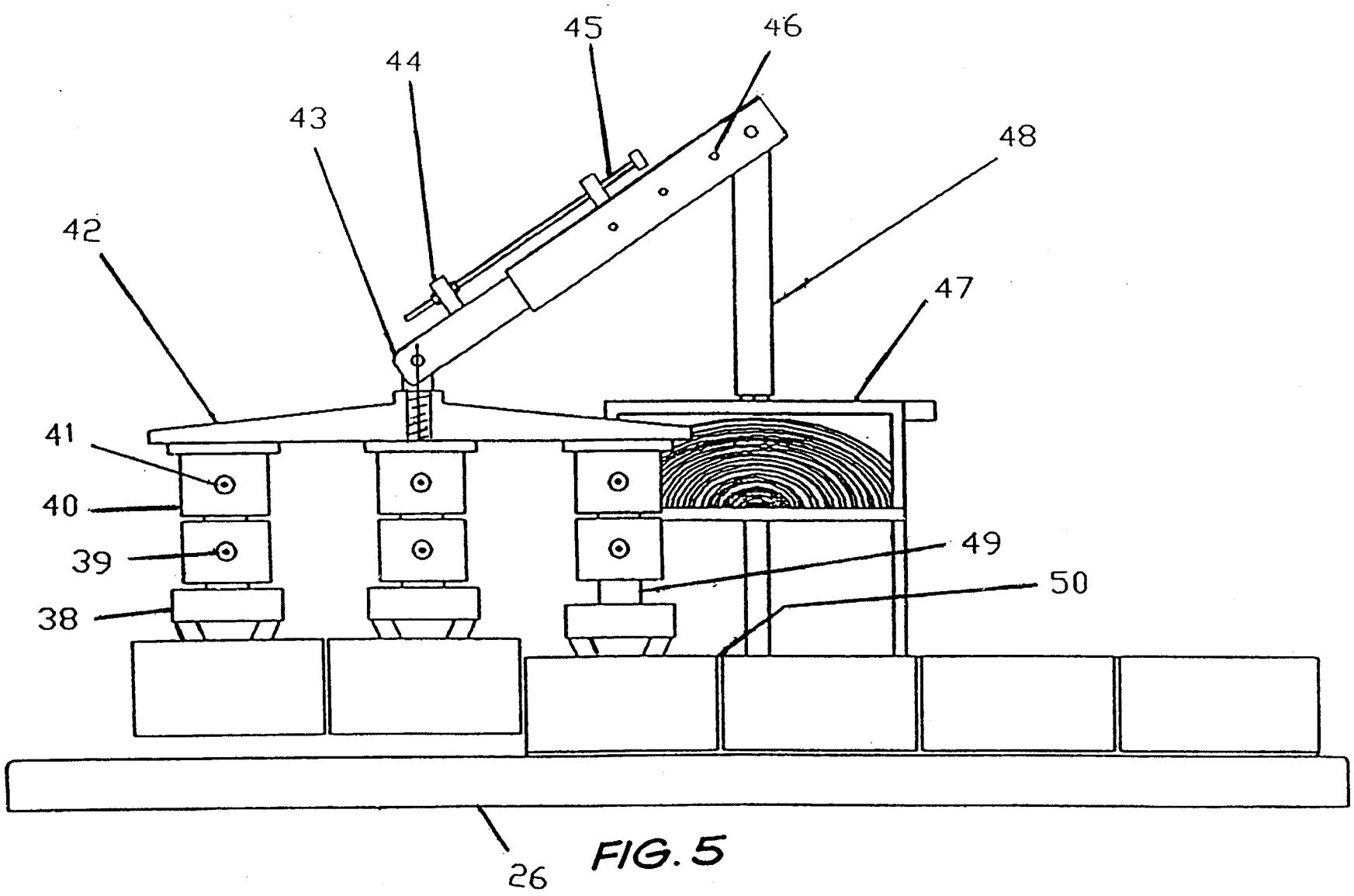
FIG. 5 is a perspective view showing how the apparatus can place three blocks and bedded wall lowering one while the other two are still suspended, also shown is the upper arm that can be extended.

FIG. 1 shows an apparatus picking up a single block with a gripping device, shown generally as member 2 in reference member 5 member has the mean to rotate by grasping member 4, the upper arm assembly member 6, connected to member 5, has the means to only a back and forth movement. Member 8, a hydraulic cylinder when energized has the means to raise or lower member 6, thus pivoting at member 7, an alternative position for member 48, this is member 9, a mortar tray member 10, that sets in a frame, reference to member 4 stretched will only keep block level, sometimes a mason may increase or decrease the length of blocks laid and will not notice it, until four or five said blocks later, then an adjustment has to be made, a level line with ⅜-inch joint spacing printed on the line will eliminate errors. Also, a mason does not have to take any measurements while this line is in place.

What is claimed is:

1. A method of constructing a wall comprised of blocks and mortar using a machine, a mortar guide and a level line having markings, said machine including a platform, rails mounted on the platform, a mobile frame, rollers mounted on the frame and riding on the rails, an articulated arm mounted to the frame, a gripper means mounted to the arm, pressurized fluid operating means mounted on the frame for moving the arm, a control switch mounted on the frame for controlling actuation of the operating means and the gripper means, and a mortar tray mounted on the frame for holding mortar, said method including the steps of:

positioning the level line in a desired horizontal orientation;

placing a plurality of blocks on the platform by moving the mobile frame and actuating the control switch;

transferring mortar from the mortar tray to a horizontal surface and applying mortar against the mortar guide;

positioning a plurality of blocks on the mortar on the surface by moving the mobile frame, actuating the control switch and visually using the markings on the level line.

* * * * *